United States Patent [19]

Satake et al.

[11] Patent Number: 4,590,500

[45] Date of Patent: May 20, 1986

[54] HEAT-SENSITIVE RECORDING SHEET

[75] Inventors: Toshimi Satake; Yoshihide Kimura; Fumio Fujimura, all of Tokyo, Japan

[73] Assignee: Jujo Paper Co., Ltd., Tokyo, Japan

[21] Appl. No.: 642,788

[22] Filed: Aug. 21, 1984

[30] Foreign Application Priority Data

Aug. 24, 1983 [JP] Japan ..... 58-153083

[51] Int. Cl.[4] ..... B41M 5/18

[52] U.S. Cl. ..... 346/209; 346/216; 427/150; 427/151

[58] Field of Search ..... 346/208–212, 346/216–218, 220, 221, 225; 427/150–152

[56] References Cited

U.S. PATENT DOCUMENTS

| | | | |
|---|---|---|---|
| 3,911,171 | 10/1975 | Janssens et al. | 346/216 |
| 4,134,847 | 1/1979 | Oda et al. | 346/212 |
| 4,498,091 | 2/1985 | Yamato et al. | 346/225 |
| 4,502,066 | 2/1985 | Satake et al. | 346/209 |
| 4,503,446 | 3/1985 | Yahagi | 346/216 |

*Primary Examiner*—Bruce H. Hess

*Attorney, Agent, or Firm*—Koda and Androlia

[57] ABSTRACT

Heat-sensitive recording sheet comprising a base sheet and a color-forming layer including a colorless basic dyestuff and an organic color-developing agent, wherein said color-forming layer comprises a metal derivative of phthalic acid monoester (having a particular formula). The sheet provides superior stability against contamination with oily substances while keeping excellent fundamental qualities thereof.

9 Claims, No Drawings

HEAT-SENSITIVE RECORDING SHEET

BACKGROUND OF THE INVENTION

1. Field of the Invention

The present invention relates to a heat-sensitive recording sheet having high stability of background brightness and of developed image against oily substances such as hair oil, oil, fat, etc.

2. Prior Art

A heat-sensitive recording sheet that utilizes a thermal color-forming reaction occurring between colorless or pale-colored chromogenic dyestuff and phenolic material, or organic acid is disclosed, for example, in the Japanese Patent Publication Nos. 4160/1968 and 14039/1970 and in the Japanese Laid-Open Patent Application No. 27736/1973, and is now widely applied for practical use.

In general, a heat-sensitive recording sheet is produced by applying the sheet surface with the coating which is prepared by individually grinding and dispersing colorless chromogenic dyestuff and color-developing material such as phenolic substance into fine particles, mixing the resultant dispersions with each other and then adding thereto binder, filler, sensitizer, slipping agent and other auxiliaries. When this sheet is heated, the coating undergoes instantaneously a chemical reaction which forms a color. In this case, various bright colors can be advantageously formed depending upon selection of specific colorless chromogenic dyestuff.

These heat-sensitive recording sheets have now been found in a wide range of applications, including medical or industrial measurement recording instruments, terminal printers of computer and information communication systems, facsimile equipments, printers of electronic calculators, automatic ticket vending machines and so on.

Heat-sensitive recording sheets are inevitably in contact with human hands in view of the function thereof as information recording sheets. Since oily substances such as conventionally used hair cosmetics or oil and fats contained in sweats appearing on skins often adhere to the hands and fingers, the heat-sensitive recording sheets may frequently be contaminated by these oily substances. By the way, since heat-sensitive recording sheets are not generally so stable against these oily substances, image density in the contaminated area may be reduced or sometimes be eliminated utterly, or discoloration occurs in the contaminated white area. Although the reasons for the above phenomena have not yet been cleared completely at present, it may be considered that the oily substances partially dissolve or instabilize the chromophoric layer or the chromophoric reaction products therein formed between fine particles of a colorless basic dyestuff and an organic color-developing agent.

SUMMARY OF THE INVENTION

It is a general object of the present invention to provide a heat-sensitive recording sheet which is stable against contamination with the oily substance.

The above-mentioned object can be performed by adding into the color-forming layer a metal salt derivative of a phthalic acid monoester represented by the following formula:

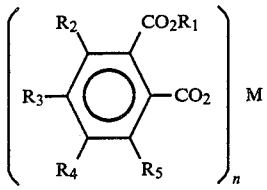

(where $R_1$ represents $CH_3$, $C_2H_5$, $C_3H_7$, iso-$C_3H_7$, tert-$C_4H_9$, $C_5H_{11}$,

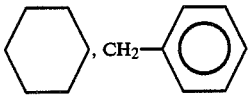

or $C_6H_5$; $R_2$, $R_3$, $R_4$ and $R_5$ present individually H, alkyl or sulfonyl group, M represents a polyvalene metal; and n represents an integer of 2 or 3.

DETAILED DESCRIPTION OF THE INVENTION

This invention will be described more in detail.

There is no particular restriction for the organic color developing agent for use in this invention and, while any kind of color developing agent may be used, most significant effect of this invention can be obtained by using, as the developing agent, a mono-phenolic 4-hydroxyphenyl compound or phthalic acid mono-ester which provides the advantage of satisfying fundamental requirements for the quality of heat-sensitive recording paper, that is, being capable of obtaining clear recording image at high density, free from troubles such as adhesion or sticking to the thermal head, excellent in the recording aptitude, as well as diminishing the fading with time.

This invention will now be described more specifically. Mono-phenolic 4-hydroxyphenyl compounds to be used as the color-developing agent in this invention include, for example, 4-hydroxybenzoic acid esters such as ethyl 4-hydroxybenzoate, propyl 4-hydroxybenzoate, isopropyl 4-hydroxybenzoate, butyl 4-hydroxybenzoate, isobutyl 4-hydroxybenzoate, benzyl 4-hydroxybenzoate and methylbenzyl 4-hydroxybenzoate; 4-hydroxyphthalic acid diesters such as dimethyl 4-hydroxyphthalate, diisopropyl 4-hydroxyphthalate, dibenzyl 4-hydroxyphthalate and dihexyl 4-hydroxyphthalate; and 4-hydroxyacetophenone, p-phenylphenol, benzyl 4-hydroxyphenyl acetate and p-benzylphenol; 4-hydroxyphenyl-4'-n-butyloxyphenylsulfone, 4-hydroxyphenyl-4'-n-hexyloxyphenylsulfone, 4-hydroxyphenyl -4'n-octyloxyphenylsulfone, 4-hydroxyphenyl-4'-n-decyloxyphenylsufone, 4-hydroxyphenyl-4'-n-dodecyloxyphenylsulfone, 4-hydroxyphenyl-4'-benzyloxyphenylsulfone, 4-hydroxyphenyl-4'-P-isopropylbenzyloxyphenylsulfone, 4-hydroxyphenyl-4'-β-phetyloxyphenylsulfone, 4-hydroxyphenyl-4'-β-ethoxyethyloxyphenylsulfone, 4-hydroxyphenyl-4'-β-butoxyethyloxyphenylsulfone, 4-hydroxyphenyl-4'-β-phenoxyethyloxyphenylsulfone, 4-hydroxyphenyl-4'-o-chlorobenzoyloxyphenylsulfone, 4-hydroxyphenyl-4'-β-t-butylbenzoyloxyphenylsulfone, 4-hydroxyphenyl-4'-β-t-octylbenzoyloxyphenylsulfone, 4-hydroxyphenyl-4'-lauroyloxyphenylsulfone, 4-hydroxyphenyl-4'-decanoyloxyphenylsulfone, 4-hydroxyphenyl-4'-myristoyloxyphenylsulfone, 4-hydroxyphenyl-4'-stearyloxyphenylsulfone, 4-hydroxyphenyl-4'-β-phenoxy propionyloxyphenylsulfone, 4-hydroxyphenyl-4'-hexadecylsulfonyloxyphenylsulfone, 4-hydroxyphenyl-4'-decylsulfonyloxyphenylsulfone, 4-hydroxyphenyl-4'-p-toluenesulfonyloxyphenylsulfone, 4-hydroxyphenyl-4'-p-isopropylbenzenesulfonyloxyphenylsulfone, 4-hydroxyphenyl-4'-(4-p-t-butylphenoxybutyloxy)phenylsulfone. 4-hydroxyphenyl-4'-(4-p-t-amylphenoxybutyloxy)phenylsulfone, 4-hydroxyphenyl-4'-(5-p-t-butylphenoxyamyloxy)phenylsulfone, 4-hydroxyphenyl-4'-(6-p-t-butylphenoxyhexyloxy)phenylsulfone.

And phthalic acid monoester to be used as the color-developing agent in this invention include, for example, phthalic acid monophenylester, phthalic acid monobenzylester, phthalic acid monocyclohexylester, phthalic acid monomethylphenylester, phthalic acid monoethylphenylester, phthalic acid monoalkyl benzylester, phthalic acid monohalogenbenzylester phthalic acid monoalkoxybenzylester, and the like.

Although these color developing agent are excellent in the fundamental requirements for the quality, they involve a drawback in that its stability against the oily substance is somewhat inferior to that of the bisphenol type color-developing agent customarily used so far.

Furthermore, although the bisphenol compounds can include, for example, 4,4'-isopropylidene diphenol (bisphenol-A), 4,4'-(1-methyl-n-hexylidene)diphenol, 4,4'-cyclohexylidene diphenol and 4,4'-thiobis(4-tertbutyl-3-methylphenol), even these color developing agent still have no sufficient stability against the oily substance in the combination with a colorless dye which is considered to have a somewhat lower color developing property.

The stability against the oily substance as described above can significantly be improved by the combined use of the metal salt derivative of the phthalic acid monoester as a stabilizer according to this invention.

As colorless basic dyestuffs for use in this invention which are usually colorless or of pale color, various types of dyestuff are well-known and can be used with no particular restriction. For instance, colorless fluoran type dyestuffs include the followings: 3-diethylamino-6-methyl-7-anilinofluoran (black), 3-(N-ethyl-p-toluidino)-6-methyl-7-anilinofluoran (black), 3-diethylamino-6-methyl-7-(o-, p-dimethylanilino)fluoran (black), 3-pyrrolidino-6-methyl-7-anilinofluoran (black), 3-piperidino-6-methyl-7-anilinofluoran (black), 3-(N-cyclohexyl-N-methylamino)-6-methyl-7-anilinofluoran (black), 3-diethylamino-7-(methatrifluoromethylanilino) fluoran (black), 3-dibutylamino-7-(orthochloroanilino) fluoran (black), 3-diethylamino-6-methylchlorofluoran (red), 3-diethylamino-6-methylfluoran (red) and 3-cyclohexyl-amino-6-chlorofluoran (orange).

Among fluoran type black color forming dyestuff, 3-diethylamino-6-methyl-(p-chloroanilino) fluoran, 3-diethylamino-7-(o-chloroanilino) fluoran, 3-(n-ethyl-p-toluidino)-6-methyl-7-anilinofluoran, 3-dibutylamino-6-methyl-(o-chloroanilino) fluoran, 3-(N-ethyl-isoamyl-)amino-6-methyl-7-anilinofluoran and the like give somewhat insufficient image density. The stability against oily material and the image density can be improved by the addition of the metal derivative of phthalic acid monoester specified in this invention into the color-developing layer.

Furthermore, those colorless basic dyestuffs other than the fluoran type dyestuffs can also be used in this invention. Specifically, while it has been impossible to use crystal violet lacton, methyl violet lacton, 3-(4-diethylamino-2-ethoxyphenyl)-3-(1-ethyl-2-methyl-indol-3-yl)4-azaphthalide and 3-(4-diethylamino-2-ethoxyphenyl)-3-(1-ethyl-2-methylindol-3-yl)-7-azaphthalide and the like in combination with the color-developing agent of mono-phenolic 4-hydroxyphenyl compound or phthalic acid monoester, since thermochromic phenomenon occurs in which the color images are eliminated immediately or gradually after the printing to make it impossible for the heat-sensitive recording sheets. However, such thermochromic phenomenon can be prevented by the use of the metal derivative of phthalic acid monoester specified in this invention as a stabilizer.

The metal derivative of phthalic acid monoester to be used as the stabilizer in this invention is that as described in above general formula, and includes, for example, metal derivative of phthalic acid monophenylester, phthalic acid monobenzylester, phthalic acid monocyclohexylester, phthalic acid monomethylphenylester, phthalic acid monoethylphenylester, phthalic acid monoalkylbenzylester, phthalic acid monohalogenbenzylester, phthalic acid monoalkoxybenzylester, 4-methylphthalic acid monobenzylester, 3-methylphthalic acid monobenzylester, 5-methylphthalic acid monobenzylester, 4-methylphthalic acid monocyclohexylester, 3-methylphthalic acid monocyclohexylester, 5-methylphthalic acid monocyclohexylester, and the like, and the metal derivative of phthalic acid monobenzylester and that of phthalic acid monocyclohexyl are preferred.

Any polyvalent metal, such as zinc, calcium, magnesium, barium, lead, etc. may be used as the metal, and zinc, calcium and magnesium are excellent. One or more of these stabilizers are employed.

The organic color-developing agent and the colorless basic dyestuff, as well as the metal salt derivative of phthalic acid monoester as mentioned above are finely pulverized in a grinder such as a ball mill, an attritor, a sand grinder or the like, or in an appropriate emulsifying apparatus into fine particles of less than several micron particle size and incorporated with various type of additives depending on the purposes to prepare a coating solution. The coating solution may usually be incorporated with binders such as polyvinyl alcohol, modified polyvinyl alcohol, hydroxyethylcellulose, methylcellulose, starches, styrene-maleic anhydride copolymer, vinylacetate-maleic anhydride copolymer and styrenebutadiene copolymer, as well as organic or inorganic filler such as kaolin, calcined kaolin, diatomaceous earth, talc, titanium oxide, calcium carbonate, magnesium carbonate and aluminum hydroxide. In addition, releasing agent such as metal salt of fatty acid, lubricant such as waxes, UV-absorber of benzophenone or triazole type, water-proofing agent such as glyoxal, dispersant, defoamer or the like can also be used. By coating the solution on paper or various types of films, aimed heat-sensitive recording sheets can be obtained.

The amount of the metal salt derivative of phthalic acid monoester, as well as the kind and the amount of various other ingredients for use in this invention are determined depending on the required performances and the recording properties with no particular restriction. However, it is usually appropriate to use 3–10 parts of the organic color-developing agent, 1–8 parts of the metal salt derivative of phthalic acid monoester and 1–20 parts of the filler per one parts of the colorless basic dyestuff, and 10–25 parts of the binder for the total solid content.

This invention will now be described more specifically referring to examples.

EXAMPLE 1

| | |
|---|---|
| Solution A (liquid dispersion of dyestuff) | |
| 3-diethylamino-6-methyl-(p-chloroanilino)fluoran | 1.5 parts |
| 10% aqueous solution of polyvinyl alcohol | 3.4 parts |
| Water | 1.9 parts |
| Solution B (liquid dispersion of color-developing agent) | |
| Benzyl p-hydroxybenzoate | 6 parts |
| Zinc stearate | 1.5 parts |
| Aqueous 10% solution of polyvinyl alcohol | 18.8 parts |
| Water | 11.2 parts |
| Solution C (liquid dispersion of stabilizer) | |
| Each of stabilizers in Table 2 | 1.0 parts |
| Aqueous 10% solution of polyvinyl alcohol | 2.5 parts |
| Water | 1.5 parts |

Each of the solutions having the foregoing compositions was ground in a ball mill into three micron particle size. Thereafter, the liquid dispersions was mixed at a ratio shown in Table 1 to form each of coating solutions.

TABLE 1

| | Composition of Coating Solution in Example 1 | | | |
|---|---|---|---|---|
| | Sample of the present invention (1–6) | Comparative sample (1) | Comparative samples (2–12) | Comparative samples (13–14) |
| Solution A (dyestuff dispersion) | 6.8 parts | 6.8 parts | 6.8 parts | 6.8 parts |
| Solution B (developing agent dispersion) | 37.5 parts | 37.5 parts | 37.5 parts | — |
| Solution C (stabilizer dispersion) | 5 parts | — | 5 parts | 5 parts |
| 50% calcium carbonate dispersion | 20 parts | 20 parts | 20 parts | 20 parts |

Each of the coating solutions was coated on one side of a paper substrate of 50 g/m$^2$ so as to provide a coating amount of 6.0 g/m$^2$ and was dried. The sheet was treated in a supercalender so as to obtain a smoothness of 200–300 seconds. The results of the quality performance tests carried out for the thus obtained black-color-developed heat-sensitive recording sheets are shown in Table 2.

TABLE 2

| | | Results of Performance Test in Example 1 | | | | | |
|---|---|---|---|---|---|---|---|
| | | Optical density(1) | | | Brightness of background(4) | | |
| | Stabilizer | Untreated | After oil(2) treatment | Residual(3) density (%) | Untreated | After oil(5) treatment | Standing(6) at 60° C., 45% RH |
| Sample of the present invention | | | | | | | |
| 1 | Lead derivative of phthalic acid monobenzylester | 1.07 | 0.80 | 74.8 | 0.07 | 0.08 | 0.11 |
| 2 | Zinc derivative of phthalic acid monobenzylester | 1.18 | 1.10 | 93.2 | 0.08 | 0.09 | 0.12 |
| 3 | Magnesium derivative of phthalic acid monobenzylester | 1.10 | 0.81 | 73.6 | 0.07 | 0.08 | 0.12 |
| 4 | Calcium derivative of phthalic acid monobenzylester | 1.12 | 0.85 | 75.9 | 0.08 | 0.08 | 0.12 |
| 5 | Lead derivative of phthalic acid monocyclohexylester | 1.10 | 0.82 | 74.6 | 0.08 | 0.09 | 0.12 |
| 6 | Zinc derivative of phthalic acid monocyclohexylester | 1.17 | 1.09 | 93.2 | 0.08 | 0.09 | 0.11 |
| Comparative samples | | | | | | | |
| 1 | None | 1.11 | 0.17 | 15.3 | 0.08 | 0.09 | 0.09 |
| 2 | Stearic acid | 1.12 | 0.15 | 13.4 | 0.08 | 0.09 | 0.11 |
| 3 | Zinc stearate | 1.10 | 0.17 | 15.5 | 0.07 | 0.09 | 0.10 |
| 4 | Calcium stearate | 1.07 | 0.16 | 15.0 | 0.07 | 0.09 | 0.11 |
| 5 | Terephthalic acid | 1.06 | 0.16 | 15.1 | 0.09 | 0.11 | 0.20 |
| 6 | Zinc terephthalate | 1.16 | 0.20 | 19.1 | 0.08 | 0.12 | 0.11 |
| 7 | Benzoic acid | 1.08 | 0.18 | 16.7 | 0.15 | 0.14 | 0.30 |
| 8 | Zinc benzoate | 1.10 | 0.60 | 54.5 | 0.08 | 0.15 | 0.36 |
| 9 | Calcium benzoate | 1.09 | 0.54 | 49.5 | 0.07 | 0.14 | 0.32 |
| 10 | t-Butylbenzoic acid | 1.09 | 0.19 | 17.4 | 0.13 | 0.10 | 0.29 |
| 11 | p-Methylbenzoic acid | 1.07 | 0.19 | 17.8 | 0.14 | 0.10 | 0.28 |
| 12 | o-Benzoylbenzoic acid | 1.08 | 0.20 | 18.5 | 0.15 | 0.09 | 0.33 |
| 13 | Zinc derivative of phthalic acid monobenzylester | 0.20 | 0.18 | 90.0 | 0.07 | 0.08 | 0.10 |
| 14 | Zinc derivative of phthalic acid monocyclohexylester | 0.21 | 0.19 | 90.5 | 0.07 | 0.08 | 0.09 |

As Table 1 shows, comparative samples Nos. 13 and 14 contained no color-developing agent.

Note (1) Optical density:
Measured in a heat-sensitive facsimile apparatus CP 6000, manufactured by TOSHIBA CORPORATION, using a Macbeth densitometer for the portion of evenly printed black under the condition of GIII-mode (using RD-104 amber filter, which is also used in other examples).

Note (2) Optical density after oil treatment:
After spreading droplets of castor oil (0.8 mg)

TABLE 2-continued dropped on a glass plate by a syringe to 40 $cm^2$, they were transferred by a rubber seal of 1 cm × 1.5 cm to the surface printed and developed by the same procedures as (1) above. After leaving for seven days, the optical density in the transferred area was measured by a Macbeth densitometer.

Note (3) Residual density:
Calculated by the following equation $$\text{Residual density} = \frac{\text{Optical density after oil treatment}}{\text{Optical density not oil treated}} \times 100\ (\%)$$

Note (4) Brightness of background:
Not developed area was measured by a Macbeth densitometer.

Note (5) Brightness of background after oil treatment:
Castor oil droplets were transferred onto a not developed area in the same procedures as in (2). After leaving for three days, the density on the transferred area was measured by Macbeth densitometer.

Note (6) Brightness of background after treatment at 60° C., 45% relative humidity:
After leasing for 24 hours under the severe conditions of 60° C. and 45% RH, a not developed area was measured by a Macbeth densitometer.

As is apparent from Table 2, Examples of the present invention using the metal salt derivative of phthalic acid monoester as the stabilizer show stable recorded images even contaminated with castor oils and possess more than 70% of residual rate for the optical density even leaving for seven days after contamination. Further, they show good stability for the brightness of background with less reduction in the brightness of background even for the oil contamination and preservation under severe conditions. Particularly, those stabilizers for use in this invention containing salts of zinc possess high residual density even after oil contaminations.

EXAMPLE 2

A solution D was prepared by replacing benzyl 4-hydroxy benzoate in the solution B of Example 1 (liquid dispersion of color-developing agent) with the identical parts by weight of monobenzylphthalate, and the solution was mixed with the solution A, the solution C, and a calcium carbonate dispersion at ratio shown in Table 3.

TABLE 3

| | Composition of the Coating Solution in Example 2 | | |
|---|---|---|---|
| | Samples of the present invention (7–12) | Comparative samples (15) | Comparative samples (16–26) |
| Solution A (dyestuff dispersion) | 4.5 parts | 4.5 parts | 4.5 parts |
| Solution B (developing agent dispersion) | 9 parts | 9 parts | 9 parts |
| Solution C (stabilizer dispersion) | 5 parts | — | 5 parts |
| 50% Calcium carbonate dispersion | 20 parts | 20 parts | 20 parts |

The results of quality performance tests for the black-color-developing heat-sensitive recording sheets obtained in the same manner as in Example 1 using each of the above solutions are shown in Table 4.

TABLE 4

| | Results of Performance Test in Example 2 | | | | | | |
|---|---|---|---|---|---|---|---|
| | | Optical density | | | Brightness of background | | |
| | Stabilizer | Untreated | After oil treatment | Residual density (%) | Un-treated | After oil treatment | Standing at 60° C., 45% RH |
| Sample of the present invention | | | | | | | |
| 7 | Lead derivative of phthalic acid monobenzylester | 1.12 | 0.91 | 81.3 | 0.08 | 0.09 | 0.09 |
| 8 | Zinc derivative of phthalic acid monobenzylester | 1.19 | 1.09 | 91.6 | 0.08 | 0.09 | 0.11 |
| 9 | Magnesium derivative of phthalic acid monobenzylester | 1.13 | 0.86 | 76.1 | 0.07 | 0.09 | 0.12 |
| 10 | Calcium derivative of phthalic acid monobenzylester | 1.14 | 0.85 | 74.6 | 0.07 | 0.08 | 0.12 |
| 11 | Lead derivative of phthalic acid monocyclohexylester | 1.11 | 0.95 | 85.6 | 0.08 | 0.09 | 0.11 |
| 12 | Zinc derivative of phthalic acid monocyclohexylester | 1.12 | 1.02 | 91.1 | 0.09 | 0.09 | 0.12 |
| Comparative samples | | | | | | | |

TABLE 4-continued

| | Stabilizer | Results of Performance Test in Example 2 | | | | | |
|---|---|---|---|---|---|---|---|
| | | Optical density | | | Brightness of background | | |
| | | Untreated | After oil treatment | Residual density (%) | Un-treated | After oil treatment | Standing at 60° C., 45% RH |
| 15 | None | 1.09 | 0.16 | 14.7 | 0.07 | 0.08 | 0.10 |
| 16 | Stearic acid | 1.10 | 0.14 | 12.7 | 0.08 | 0.11 | 0.11 |
| 17 | Zinc stearate | 1.09 | 0.17 | 15.6 | 0.08 | 0.08 | 0.09 |
| 18 | Calcium stearate | 1.05 | 0.14 | 13.3 | 0.08 | 0.09 | 0.11 |
| 19 | Terephthalic acid | 1.04 | 0.10 | 9.6 | 0.10 | 0.14 | 0.28 |
| 20 | Zinc terephthalate | 1.10 | 0.18 | 16.4 | 0.10 | 0.13 | 0.20 |
| 21 | Benzoic acid | 1.06 | 0.17 | 16.0 | 0.14 | 0.16 | 0.28 |
| 22 | Zinc benzoate | 1.08 | 0.61 | 56.5 | 0.09 | 0.17 | 0.38 |
| 23 | Calcium benzoate | 1.07 | 0.50 | 46.7 | 0.08 | 0.16 | 0.37 |
| 24 | t-Butylbenzoic acid | 1.06 | 0.18 | 17.0 | 0.14 | 0.11 | 0.30 |
| 25 | p-Methylbenzoic acid | 1.06 | 0.18 | 17.0 | 0.13 | 0.11 | 0.31 |
| 26 | o-Benzoylbenzoic acid | 1.05 | 0.17 | 16.2 | 0.16 | 0.10 | 0.30 |

In Table 4, the effect of the stabilizer according to the present invention is shown remarkably also in the case of using monobenzyl terephthalate, as the color-developing agent.

EXAMPLE 3

| | |
|---|---|
| Solution A (liquid dispersion of dyestuff) | |
| 3-(N—ethyl-N—isoamyl)amino-6-methyl-7-anilinofluoran | 1.5 parts |
| 10% aqueous solution of polyvinyl alcohol | 3.4 parts |
| Water | 1.9 parts |
| Solution B (liquid dispersion of color-developing agent) | |
| Each of color developing agents in Table 5 | 6 parts |
| Benzyl p-hydroxybenzoate | 3.0 parts |
| Zinc stearate | 1.5 parts |
| Aqueous 10% solution of polyvinyl alcohol | 26.3 parts |
| Water | 15.7 parts |
| Solution C (liquid dispersion of stabilizer) | |
| Zinc derivative of phthalic acid mono-benzylester | 1.0 parts |
| Aqueous 10% solution of polyvinyl alcohol | 2.5 parts |
| Water | 1.5 parts |

Each of the solutions having the foregoing compositions was ground in an attritor into three micron particle size. Thereafter, the liquid dispersions was mixed at a ratio shown in following Table to form each of coating solutions.

TABLE

| | Composition of Coating Solution in Example 1 | |
|---|---|---|
| | Samples of the present invention (13–16) | Comparative samples (27–30) |
| Solution A (dyestuff dispersion) | 6.8 parts | 6.8 parts |
| Solution B (developing agent dispersion) | 52.5 parts | 52.5 parts |
| Solution C (stabilizer dispersion) | 6 parts | — |
| 50% calcium carbonate dispersion | 20 parts | 20 parts |

The results of quality performance tests for the black-color-developing heat-sensitive recording sheets obtained in the same manner as in Example 1 using each of the above solutions are shown in Table 5.

| | Color-developing agent | Optical density(1) | | | Brightness of background(4) | |
|---|---|---|---|---|---|---|
| | | Un-treated | After oil treat-ment | Residual density (%) | Un-treated | After oil treat-ment |
| Sample of the present invention | | | | | | |
| 13 | Benzyl 4-hydroxy-benzoate | 1.20 | 1.10 | 92 | 0.08 | 0.09 |
| 14 | Phthalic acid mono-benzyl ester | 1.18 | 1.09 | 92 | 0.08 | 0.09 |
| 15 | Bisphenol A | 1.06 | 0.80 | 75 | 0.09 | 0.10 |
| 16 | Bis-(4-hydro-xy-3-tert-butyl-6-methylphenyl) sulfide | 1.02 | 0.82 | 80 | 0.09 | 0.10 |
| Comparative samples | | | | | | |
| 27 | Benzyl 4-hydroxybenzo-ate | 1.18 | 0.26 | 22 | 0.08 | 0.08 |
| 28 | Phthalic acid monobenzyl ester | 1.16 | 0.25 | 22 | 0.08 | 0.08 |
| 29 | Bisphenol A | 1.00 | 0.30 | 30 | 0.08 | 0.08 |

-continued

| | Color-developing agent | Optical density(1) Un-treated | After oil treat-ment | Residual density (%) | Brightness of background(4) Un-treated | After oil treat-ment |
|---|---|---|---|---|---|---|
| 30 | Bis-(4-hydro-xy-3-tert-butyl-6-methylphenyl) sulfide | 1.01 | 0.60 | 59 | 0.08 | 0.09 |

As obviously seen from Table 5, zinc derivative of pthalic acid monoester provides stable recorded images, and particularly, very stable recorded images in use of 4-hydroxybenzoic acid ester or phthalic acid monoester as color developing agent.

We claim:

1. Heat-sensitive recording sheet having a color forming layer comprising a colorless basic dyestuff and a organic color-developing agent, wherein said color-forming layer contains a metal derivative of phthalic acid monoester having the general formula (I) as stabilizer

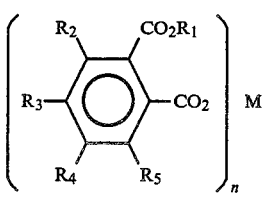

(I)

where $R_1$ represents $CH_3$, $C_2H_5$, $C_3H_7$, iso-$C_3H_7$, tert-$C_4$-$H_9$, $C_5H_{11}$,

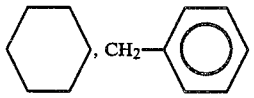

or $C_6H_5$; $R_2$, $R_3$, $R_4$ and $R_5$ represent individually H, alkyl or sulfonyl group; M represents a polyvalent metal; and n represents an integer of 2 or 3.

2. Heat-sensitive recording sheet according to claim 1, wherein said metal derivative of phthalic acid monoester is at least one substance selected from the group consisting of phthalic acid monobenzylester and phthalic acid monocyclohexylester.

3. Heat-sensitive recording sheet according to claim 1 or 2, wherein M in the formula (I) is at least one metal selected from the group consisting of calcium and magnesium.

4. Heat-sensitive recording sheet according to claim 3, wherein said organic color-developing agent is at least one substance selected from the group consisting of mono-phenolic 4-hydroxyphenyl compound phthalic acid monoester.

5. Heat-sensitive recording sheet according to claim 4, wherein said color forming layer contains 3–10 parts by weight of the organic developing agent, 1–8 parts by weight of metal derivative of phthalic acid monoester, 1–20 parts by weight of the filler per one part by weight of the colorless basic dyestuff, and 10–25 parts by weight of the binder for total solid content of the layer.

6. Heat-sensitive recording sheet according to claim 3, wherein said color forming layer contains 3–10 parts by weight of the organic developing agent, 1–8 parts by weight of metal derivative of phthalic acid monoester, 1–20 parts by weight of the filler per one part by weight of the colorless basic dyestuff, and 10–25 parts by weight of the binder for total solid content of the layer.

7. Heat-sensitive recording sheet according to claim 1 or 2, wherein said organic color developing agent is at least one substance selected from the group consisting of mono-phenolic 4-hydroxyphenyl compound and phthalic acid monoester.

8. Heat-sensitive recording sheet according to claim 7, wherein said color forming layer contains 3–10 parts by weight of the organic developing agent, 1–8 parts by weight of metal derivative of phthalic acid monoester, 1–20 parts by weight of the filler per one part by weight of the colorless basic dyestuff, and 10–25 parts by weight of the binder for total solid content of the layer.

9. Heat-sensitive recording sheet according to claim 1 or 2, wherein said color forming layer contains 3–10 parts by weight of the organic developing agent, 1–8 parts by weight of metal derivative of phthalic acid monoester, 1–20 parts by weight of the filler per one part by weight of the colorless basic dyestuff, and 10–25 parts by weight of the binder for total solid content of the layer.

* * * * *